US005601503A

United States Patent [19]

Yamagishi et al.

[11] Patent Number: 5,601,503

[45] Date of Patent: Feb. 11, 1997

[54] GOLF BALL

[75] Inventors: Hisashi Yamagishi; Hiroshi Higuchi; Jun Shindo, all of Chichibu, Japan

[73] Assignee: Bridgestone Sports Co., Ltd., Tokyo, Japan

[21] Appl. No.: 613,201

[22] Filed: Mar. 6, 1996

[30] Foreign Application Priority Data

Mar. 6, 1995 [JP] Japan ..... 7-072349

[51] Int. Cl.[6] ..... A63B 37/14

[52] U.S. Cl. ..... 473/384; 473/351; 473/280

[58] Field of Search ..... 473/371, 383, 473/384, 280, 372, 377, 352, 351

[56] References Cited

U.S. PATENT DOCUMENTS

| | | | |
|---|---|---|---|
| 3,069,170 | 12/1962 | Dillon | 473/371 X |
| 3,940,145 | 2/1976 | Gentiluomo | 473/371 X |
| 3,979,126 | 9/1976 | Dusbiber | 473/372 |
| 4,123,061 | 10/1978 | Dusbiber | 473/377 |
| 4,836,552 | 6/1989 | Purkett et al. | 473/371 X |
| 4,840,381 | 6/1989 | Ihara et al. | 473/365 |
| 5,368,304 | 11/1994 | Sullivan et al. | 473/377 |

FOREIGN PATENT DOCUMENTS 2235879 3/1991 United Kingdom .

*Primary Examiner*—George J. Marlo

*Attorney, Agent, or Firm*—Sughrue, Mion, Zinn, Macpeak & Seas

[57] ABSTRACT

A golf ball having a multiplicity of dimples in its surface is adjusted to a weight of 40 to 45 grams and a diameter of 43 to 47 mm. The dimples occupy at least 60% of the ball surface and satisfy $0.35 \leqq V_0 \leqq 0.60$ wherein $V_0$ is the volume of the dimple space below a circular plane circumscribed by a dimple edge, divided by the volume of a cylinder whose bottom is the circular plane and whose height is the maximum depth of the dimple from the bottom. The ball is improved in flying performance in that it offers an adequate trajectory and an increased flying distance when hit by an ordinary golfer with a head speed of about 40 m/sec. with a driver or long iron. Hitting feel is also improved.

1 Claim, 2 Drawing Sheets

GOLF BALL

BACKGROUND OF THE INVENTION

1. Field of the Invention

This invention relates to solid golf balls suitable for those golfers who swing at a head speed of about 40 m/sec.

2. Prior Art

For golf balls, various proposals have been made for improving their flying distance and hitting feel. Most of these advanced golf balls are adjusted so as to exert optimum performance when hit at a head speed of about 45 m/sec. They are not necessarily best suited for ordinary golfers who swing at a head speed of about 40 m/sec. It is commonly seen that ordinary golfers are disappointed with flying distances shorter than expected when they shoot balls with a driver, probably because the balls tend to follow a low trajectory.

SUMMARY OF THE INVENTION

An object of the present invention is to provide a novel and improved golf ball suitable for ordinary golfers who swing at a head speed of about 40 m/sec. which offers an increased flying distance and a pleasant feel especially when hit with a driver.

The present invention provides a golf ball having a multiplicity of dimples in its surface. The golf ball has a weight of 40 to 45 grams and an outer diameter of 43 to 47 mm. The dimples occupy at least 60% of the ball surface. Provided that each dimple has a circular edge, the dimples satisfy $0.35 \leqq V_0 \leqq 0.60$ wherein $V_0$ is the volume of the dimple space below a circular plane circumscribed by the dimple edge, divided by the volume of a cylinder whose bottom is the circular plane and whose height is the maximum depth of the dimple from the bottom. When ordinary golfers with a head speed of 35 to 45 m/sec., especially about 40 m/sec. hit the inventive ball with a driver, the ball will follow an adequate high trajectory rather than following a low or sharply climbing trajectory, covering an increased flying distance. In addition, the ball offers a pleasant feel on such shots.

The advantages of the invention are described in detail. It occurs very often that when ordinary golfers with a head speed of about 40 m/sec. hit golf balls with a driver, the trajectory is low and the flying distance is far from satisfactory. It is generally known that the ball should be reduced in weight in order to provide a higher trajectory.

When a golf ball is hit into the air by a club, gravity (g), an aerodynamic lift (L) and an aerodynamic drag (D) act on the flying ball.

$$\text{Lift } L = \tfrac{1}{2}\rho V^2 S C_L \quad (1)$$

$$\text{Drag } D = \tfrac{1}{2}\rho V^2 S C_D \quad (2)$$

ρ: air density

V: ball velocity

S: ball cross-sectional area $C_L$: lift coefficient $C_D$: drag coefficient

An inertial force F acts on the ball which is expressed by:

$$\text{inertial force } F = mg + D + L \quad (3)$$

wherein the ball has a mass m. Kinetic equations of the golf ball flying through the air are expressed by the equations:

$$mx = -D\cos\theta - L\sin\theta \quad (4)$$

$$my = -mg - D\sin\theta + L\cos\theta \quad (5)$$

wherein θ is an in-flight angle of the ball relative to the ground or horizontal plane.

It is understood that as the mass of the ball is reduced, the inertial force is reduced as seen from equation (3), resulting in a reduced flying distance. On the other hand, the gravitational action on the ball is reduced as seen from equation (5), resulting in a higher trajectory.

The golf ball has the problem that reducing the ball weight will lead to a higher trajectory, but a shorter flying distance. We have found that a golf ball having a weight of 40 to 45 grams, an outer diameter of 43 to 47 mm, and dimples occupying at least 60% of the ball surface and satisfying $0.35 \leqq V_0 0.60$ wherein $V_0$ is as defined above has improved flying performance in that it follows an adequately high trajectory to ensure an increased flying distance without following a low or sharply climbing trajectory when ordinary golfers with a head speed of about 40 m/sec. shoot it with a driver. The ball offers a light and pleasant feel on hitting. The ball allows the player to take the proper posture or stance on address and is visually attractive in this respect too. It rolls satisfactorily on putting. For use by ordinary or average golfers, the inventive ball gives a feel that it is easy to fly high and comfortable to play. Actually, the ball has improved playability.

BRIEF DESCRIPTION OF THE DRAWINGS

These and further features of the present invention will be apparent with reference to the following description and drawings, wherein.

DETAILED DESCRIPTION OF THE INVENTION

The golf ball of the present invention has a multiplicity of dimples in its surface. The ball has a weight of 40 to 45 grams and an outer diameter of 43 to 47 mm. The dimples occupy at least 60% of the ball surface. Provided that each dimple has a circular edge, the dimples satisfy $0.35 \leqq V_0 \leqq 0.60$ wherein $V_0$ is the volume of the dimple space below a circular plane circumscribed by the dimple edge, divided by the volume of a cylinder whose bottom is the circular plane and whose height is the maximum depth of the dimple from the bottom.

More particularly, the golf ball of the invention is made relatively lightweight and has a weight of 40 to 45 grams, preferably 41.5 to 44.8 grams. A ball having a weight of less than 40 grams is light enough to receive wind resistance in flight so that its trajectory may be deflected, and is too low in inertial force to cover a long flying distance. On the other hand, a ball having a weight of more than 45 grams is inferior in hitting feel and difficult to hit high. Balls having a weight in excess of 45.92 grams are not acceptable as game balls according to the Rules of Golf.

The golf ball has an outer diameter of 43 to 47 mm, preferably 43.3 to 46.3 mm. Outside the range, smaller diameter balls are difficult to hit high, not different from conventional golf balls, and detrimental to take the proper posture or stance upon address, failing to attain the objects of the invention. Larger diameter balls look overbearing upon address.

The golf ball has a multiplicity of dimples. The percent occupation of the ball surface by the dimples is at least 60%, preferably at least 65%. The upper limit may be 88%, especially 85%. The percent dimple occupation is a factor of adjusting the trajectory of a flying ball. If the percent dimple occupation is less than 60%, the trajectory becomes rather declining and the flying distance is reduced.

It is assumed that each dimple has a circular edge. Then the dimple space below a circular plane circumscribed by the dimple edge has a volume (Vp), and a cylinder whose bottom is the circular plane and whose height is the maximum depth of the dimple from the bottom has a volume (Vq). According to the invention, $V_0$ given as the dimple space volume (Vp) divided by the cylinder volume (Vq) should be from 0.35 to 0.60, preferably from 0.36 to 0.58. $V_0$ is an important factor to obtain a stable in-flight angle and trajectory. With $V_0<0.35$, the trajectory becomes rather declining. With $V_0<0.60$, the trajectory is not extensible, that is, the ball follows a rather stalling trajectory. In either case, the flying distance is short.

Figure 1:
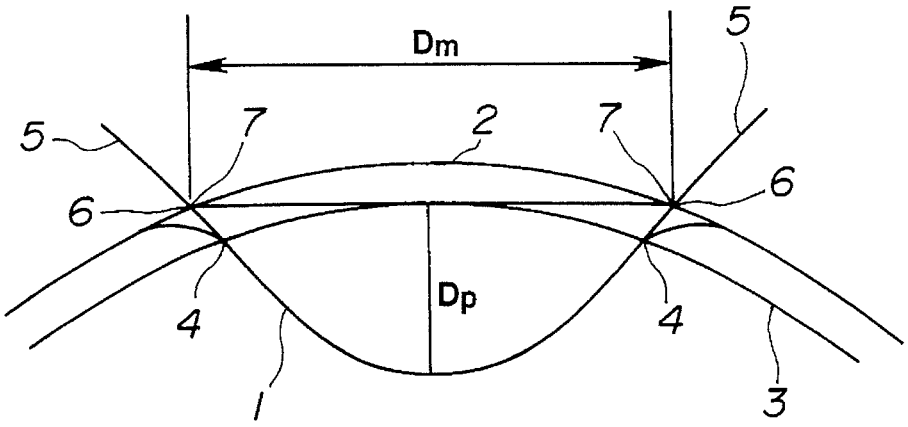
FIGS. 1, 2, and 3 are schematic views illustrating how to calculate the dimple space volume and cylinder volume.
Figure 2:
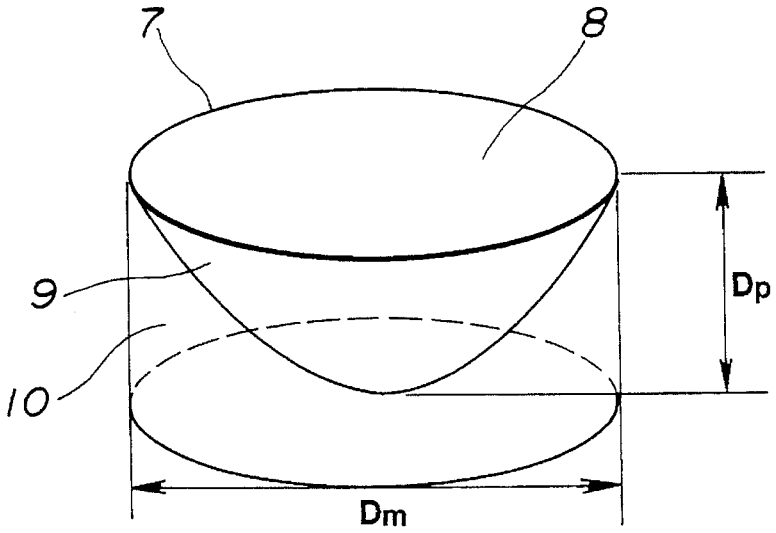
Figure 3:
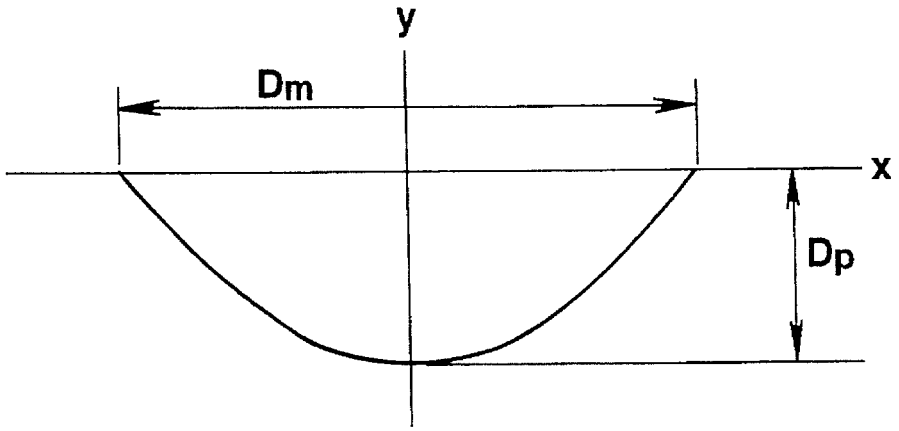

Referring to FIGS. 1 to 3, the shape of dimples is described in further detail. For simplicity sake, it is now assumed that the shape of a dimple projected on a plane is circular. One dimple in a ball surface is shown in the schematic cross-sectional view of FIG. 1. The ball has dimples, one of which is depicted at 1, in its spherical surface. In conjunction with the dimple 1, there are drawn a phantom sphere 2 having the ball diameter and another phantom sphere 3 having a diameter smaller by 0.16 mm than the ball diameter. The other sphere 3 intersects with the dimple 1 at a point 4. A tangent 5 at intersection 4 intersects with the phantom sphere 2 at a point 6. A series of intersections 6 define a dimple edge 7. The dimple edge 7 is so defined for the reason that otherwise, the exact position of the dimple edge cannot be determined because the actual edge of the dimple 1 is rounded. The dimple edge 7 circumscribes a circular plane 8 having a diameter Dm. Then as shown in FIG. 2, the dimple space 9 located below the circular plane 8 has a volume Vp. A cylinder 10 whose bottom is the circular plane 8 and whose height is the maximum depth Dp of the dimple from the bottom or circular plane 8 has a volume Vq. As shown in FIG. 3, the volume Vp of the dimple space 9 and the volume Vq of the cylinder 10 are calculated according to the following equations. The dimple space volume Vp is divided by the cylinder volume Vq to give a ratio $V_0$.

$$Vp = \int_0^{\frac{Dm}{2}} 2\pi xy dx$$

$$Vq = \frac{\pi Dm^2 Dp}{4}$$

$$V_0 = \frac{Vp}{Vq}$$

It is noted that an equivalent diameter is used in the event that the shape of a dimple projected on a plane is not circular. That is, the maximum diameter or length of a dimple projected on a plane is determined, the plane projected shape of the dimple is assumed to be a circle having a diameter equal to this maximum diameter or length, and $V_0$ is calculated as above based on this assumption.

Preferably the ball has about 300 to 550 dimples, more preferably about 360 to 450 dimples. The dimples may be arranged in any desired pattern as in conventional golf balls. There may be two or more types of dimples which are different in diameter and/or depth. It is preferred that the dimples have a diameter of 2.5 to 4.4 mm and a depth of 0.10 to 0.25 mm.

The inventive golf ball is most often formed as a two-piece golf ball. However, it may be either a one-piece golf ball or a multiple solid golf ball wherein the solid core includes two or more layers. It may also be a wound golf ball having a wound core. The cover may be either a single layer structure or a multilayer structure.

The materials and preparation methods of the one-piece golf ball, solid core, wound core, and cover are not critical. They may be formed of any desired one of well-known materials insofar as the desired golf ball performance is achievable.

For example, the solid core used in the solid golf ball according to the invention is formed by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polybutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 0.5 to 3 parts by weight, preferably about 0.8 to 1.5 parts by weight of the crosslinking agent is blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. About 15 to 40 parts by weight, preferably about 20 to 35 parts by weight of the co-crosslinking agent is blended with 100 parts by weight of the base rubber. In the case of one-piece golf balls, the co-crosslinking agent is preferably zinc methacrylate and used in an amount of 0 to about 25 parts by weight, more preferably about 5 to 20 parts by weight per 100 parts by weight of the base resin. Examples of the inert filler include zinc oxide, barium sulfate, silica, calcium carbonate, and zinc carbonate, with zinc oxide being often used. The amount of the filler blended is preferably about 1 to about 25 parts by weight per 100 parts by weight of the base rubber although the amount largely varies with the specific gravity of the core and cover, the weight of the ball, and other factors.

A core-forming composition is prepared by kneading the above-mentioned components in a conventional mixer such as a Banbury mixer and roll mill, and it is compression or injection molded in a core mold. The molding is then cured by heating at a sufficient temperature for the crosslinking agent and co-crosslinking agent to function (for example, a temperature of about 130° to 170° C. for a combination of dicumyl peroxide as the crosslinking agent and zinc acrylate as the co-crosslinking agent), obtaining a core.

In the case of a two-layer core, the inner core may be formed of a material similar to the above-mentioned one and the outer core may be formed of a material similar to the above-mentioned one or a resinous material such as an ionomer resin. Typically the outer core is formed over the inner core by compression or injection molding.

Also a wound core may be formed from well-known materials by conventional methods. The wound core may have either a liquid center or a solid center, which is covered with thread rubber.

In the practice of the invention, a golf ball having a relatively light weight as specified above is preferably prepared by reducing the amount of filler blended in a core composition to form a lightweight core.

The core may have any desired hardness. It is recommended from the standpoints of restitution, flying distance and feel that the core undergoes a distortion of 2.2 to 5.0 mm, especially 2.7 to 4.5 mm under an applied load of 100 kg.

Also the cover material is not critical and well-known cover materials are useful. Covers made of ionomer resins, especially lithium Surlyn and Surlyn mixtures containing the same are preferred for the objects of the invention.

The cover may have any desired hardness, preferably at least 60 degrees on the Shore D scale, more preferably 62 to 70 degrees on the Shore D scale. If the cover hardness is less than 60 degrees in Shore D, the ball becomes less repulsive and receives a more spin and a larger launch angle upon hitting so that the ball may climb high and stall, failing to cover a long flying distance. Too increased Shore D hardness means that the cover is too hard so that the golf ball may be less durable.

Preferably the cover is formed around the core to a radial thickness of 1.4 to 2.4 mm, especially 1.5 to 2.3 mm. A cover of less than 1.4 mm in thickness would be low in cut resistance so that the ball might be less durable. A cover of more than 2.4 mm in thickness would give a dull feel upon hitting and a ball with such a thick cover would become less repulsive.

The manner of enclosing the core with the cover is not critical. In a common practice, a pair of cover halves are previously molded in hemispherical shape, the core is enclosed with the pair of cover halves, and the assembly is heated and molded under pressure. It is also acceptable to injection mold a cover-forming composition over the core.

Golf balls having the above-specified parameters can be prepared by suitably selecting the type and amount of the materials for the core and cover and properly controlling vulcanizing and other preparation conditions.

EXAMPLE

Examples of the present invention are given below by way of illustration and not by way of limitation. All parts are by weight.

EXAMPLES 1–4 & COMPARATIVE EXAMPLES 1–3

Solid cores or one-piece golf balls as shown in Table 1 were prepared by blending the following components. Each compound was molded into a core (or ball) in a mold and heated at 155° C. for about 20 minutes for thoroughly vulcanizing the core (or ball).

| Solid core material for two and three-piece golf balls | |
|---|---|
| Cis-1,4-polybutadiene rubber (BR01) | 100 parts |
| Zinc acrylate | 18–35 parts |
| Zinc oxide | 0–30 parts |
| Antioxidant | 0.2 part |
| Dicumyl peroxide | 0.9 part |
| Zinc acrylate/zinc oxide | hardness adjustment |
| Barium sulfate | specific gravity adjustment |
| One-piece golf balls | |
| Cis-1,4-polybutadiene rubber (BR01) | 100 parts |
| Zinc methacrylate | 5–20 parts |
| Zinc oxide | 5–20 parts |
| Antioxidant | 0.2 part |
| Dicumyl peroxide | 0.5–5.0 parts |

In the case of two and three-piece golf balls, covers were formed by blending ionomer resins, Himilan 1608 and 1706 in a weight ratio of 50/50. The compound was injection molded over the solid cores, obtaining golf balls having an outer diameter as shown in Table 1.

The golf balls had an octahedral arrangement of dimples as shown in Table 2.

Using a swing robot manufactured by True Temper Co., the golf balls were hit by a driver at a head speed (HS) of 40 m/sec. for determining carry, total, and in-flight angle.

Using a panel of three male senior golfers, the balls were evaluated for ease of posturing and hitting feel according to the following rating.

Ease of posturing

⊙: very easy

O: easy

Δ: fair

Feel

⊙: light and smooth ball take-off

O: good

Δ: fair

TABLE 1

| | | Ball | | Dimple | | Head speed 40 m/sec. | | | Ease of | |
|---|---|---|---|---|---|---|---|---|---|---|
| | | Diameter | Weight | Group | Surface occupation (%) | Carry (m) | Total | Angle (°) | posturing | Feel |
| E 1 | 2 piece | 44.80 | 42.50 | A | 61.5 | 191.0 | 207.5 | 12.7 | O | ⊙ |
| E 2 | 2 piece | 43.50 | 43.50 | B | 76.3 | 191.7 | 206.8 | 12.8 | O | ⊙ |
| E 3 | 1 piece | 45.90 | 44.00 | C | 72.2 | 193.0 | 207.0 | 12.9 | ⊙ | ⊙ |
| E 4 | 3 piece | 46.10 | 44.50 | B | 67.9 | 192.0 | 207.1 | 12.6 | ⊙ | ⊙ |
| CE1 | 2 piece | 42.70 | 45.30 | D | 57.1 | 190.8 | 205.0 | 12.3 | Δ | Δ |
| CE2 | 2 piece | 42.70 | 44.00 | A | 67.6 | 190.4 | 205.1 | 12.5 | Δ | Δ |
| CE3 | 1 piece | 45.70 | 44.90 | A | 59.1 | 189.5 | 203.8 | 12.8 | ⊙ | O |

TABLE 2

| Dimple group | Diameter | Number | $V_0$ | Total dimple area ($mm^2$) |
|---|---|---|---|---|
| A | 3.85 mm | 144 | 0.375 | |
| | 3.60 mm | 216 | 0.413 | 3875 |
| B | 4.10 mm | 264 | 0.520 | |
| | 3.70 mm | 72 | 0.520 | |
| | 2.55 mm | 54 | 0.520 | 4535 |
| C | 4.20 mm | 264 | 0.560 | |
| | 3.85 mm | 72 | 0.560 | |
| | 2.60 mm | 54 | 0.560 | 4782 |
| D | 3.40 mm | 360 | 0.345 | 3269 |

There has been described a golf ball which is improved in flying performance in that it offers an adequate trajectory and an increased flying distance when hit by an ordinary golfer with a head speed of about 40 m/sec. with a driver or long iron. Hitting feel is also improved. The ball also looks easy on address and rolls well on putting.

Japanese Patent Application No. 72349/1995 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a multiplicity of dimples in its surface, said golf ball having a weight of 40 to 45 grams and a diameter of 43 to 47 mm, wherein the dimples occupy at least 60% of the ball surface and satisfy the condition:

$$0.35 \leqq V_0 \leqq 0.60$$

wherein provided that each dimple has a circular edge, $V_0$ is the volume of the dimple space below a circular plane circumscribed by the dimple edge, divided by the volume of a cylinder whose bottom is said circular plane and whose height is the maximum depth of the dimple from the bottom.

* * * * *